US010154689B2

(12) United States Patent
Nordskog et al.

(10) Patent No.: US 10,154,689 B2
(45) Date of Patent: Dec. 18, 2018

(54) HEAT GENERATION SEGMENT FOR AN AEROSOL-GENERATION SYSTEM OF A SMOKING ARTICLE

(71) Applicant: R. J. REYNOLDS TOBACCO COMPANY, Winston-Salem, NC (US)

(72) Inventors: Brian Keith Nordskog, Winston-Salem, NC (US); Thaddeus J. Jackson, High Point, NC (US); Donna Walker Duggins, Winston-Salem, NC (US); Anthony Richard Gerardi, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 348 days.

(21) Appl. No.: 14/755,205

(22) Filed: Jun. 30, 2015

(65) Prior Publication Data

US 2017/0000188 A1 Jan. 5, 2017

(51) Int. Cl.

| | |
|---|---|
| ***A24F 47/00*** | (2006.01) |
| ***A24B 15/16*** | (2006.01) |
| ***C10L 11/04*** | (2006.01) |
| ***C10L 9/10*** | (2006.01) |

(52) U.S. Cl.

CPC ..... *A24F 47/006* (2013.01); *A24B 15/165* (2013.01); *C10L 9/10* (2013.01); *C10L 11/04* (2013.01); *C10L 2200/029* (2013.01); *C10L 2200/0218* (2013.01); *C10L 2200/0272* (2013.01); *C10L 2200/0469* (2013.01); *C10L 2230/06* (2013.01); *C10L 2250/06* (2013.01); *C10L 2270/08* (2013.01)

(58) Field of Classification Search

CPC ..... A24F 47/006; A24B 15/165; A24B 15/10; A24B 15/16; C10L 11/04

See application file for complete search history.

(56) References Cited

U.S. PATENT DOCUMENTS

| | | | |
|---|---|---|---|
| 4,714,082 A | 12/1987 | Banerjee et al. | |
| 4,756,318 A | 7/1988 | Clearman et al. | |
| 4,819,665 A | 4/1989 | Roberts et al. | |
| 4,881,556 A | 11/1989 | Clearman et al. | |

(Continued)

FOREIGN PATENT DOCUMENTS

| | | | | |
|---|---|---|---|---|
| CN | 1068024 A * | 1/1993 | ..... | A24B 15/165 |
| EP | 1 808 087 | 7/2007 | | |

(Continued)

*Primary Examiner* — Edmund H Lee

*Assistant Examiner* — Jamel M Nelson

(74) *Attorney, Agent, or Firm* — Womble Bond Dickinson (US) LLP

(57) ABSTRACT

A fuel element adapted for use in a smoking article is provided, the fuel element including a combustible carbonaceous material in an amount of at least 25% by dry weight, based on the weight of the fuel element, and a particulate ignition aid dispersed throughout the fuel element and selected from ceramic particles, cellulose particles, fullerenes, impregnated activated carbon particles, inorganic salts, and combinations thereof, wherein the average particle size of the ignition aid is less than about 1,000 microns. Also provided are elongate smoking articles having a lighting end and an opposed mouth end, and including the above-noted fuel element configured for ignition of the lighting end.

23 Claims, 3 Drawing Sheets

(56) References Cited

U.S. PATENT DOCUMENTS

| | | | | |
|---|---|---|---|---|
| 4,989,619 | A | 2/1991 | Clearman et al. | |
| 5,020,548 | A | 6/1991 | Farrier et al. | |
| 5,027,837 | A | 7/1991 | Clearman et al. | |
| 5,067,499 | A | 11/1991 | Banerjee et al. | |
| 5,076,292 | A | 12/1991 | Sensabaugh, Jr. et al. | |
| 5,076,297 | A | 12/1991 | Farrier et al. | |
| 5,099,861 | A | 3/1992 | Clearman et al. | |
| 5,105,831 | A | 4/1992 | Banerjee et al. | |
| 5,129,409 | A | 7/1992 | White et al. | |
| 5,148,821 | A * | 9/1992 | Best | A24B 15/26 131/356 |
| 5,156,170 | A | 10/1992 | Clearman et al. | |
| 5,178,167 | A | 1/1993 | Riggs et al. | |
| 5,183,062 | A | 2/1993 | Clearman et al. | |
| 5,203,355 | A | 4/1993 | Clearman et al. | |
| 5,211,684 | A | 5/1993 | Shannon et al. | |
| 5,204,014 | A | 8/1993 | Deevi et al. | |
| 5,240,014 | A | 8/1993 | Deevi et al. | |
| 5,247,947 | A | 9/1993 | Clearman et al. | |
| 5,247,949 | A | 9/1993 | Deevi et al. | |
| 5,345,955 | A | 9/1994 | Clearman et al. | |
| 5,469,871 | A | 11/1995 | Barnes et al. | |
| 5,551,451 | A * | 9/1996 | Riggs | A24F 47/004 131/194 |
| 5,560,376 | A | 10/1996 | Meiring et al. | |
| 5,588,446 | A | 12/1996 | Clearman | |
| 5,706,834 | A | 1/1998 | Meiring et al. | |
| 5,727,571 | A | 3/1998 | Meiring et al. | |
| 6,503,475 | B1 | 1/2003 | McCormick et al. | |
| 7,011,096 | B2 | 3/2006 | Li et al. | |
| 7,836,897 | B2 | 11/2010 | Borschke et al. | |
| 8,464,726 | B2 | 6/2013 | Sebastian et al. | |
| 8,469,035 | B2 | 6/2013 | Banerjee et al. | |
| 8,617,263 | B2 | 12/2013 | Banerjee et al. | |
| 2002/0014453 | A1 | 2/2002 | Lilly, Jr. et al. | |
| 2002/0167118 | A1 | 11/2002 | Billiet et al. | |
| 2002/0172826 | A1 | 11/2002 | Yadav et al. | |
| 2002/0194958 | A1 | 12/2002 | Lee et al. | |
| 2003/0000538 | A1 | 1/2003 | Bereman | |
| 2004/0173229 | A1 | 9/2004 | Crooks et al. | |
| 2005/0066986 | A1 | 3/2005 | Nestor et al. | |
| 2005/0274390 | A1 * | 12/2005 | Banerjee | A24B 15/165 131/334 |
| 2007/0215167 | A1 | 9/2007 | Llewellyn Crooks et al. | |
| 2007/0215168 | A1 | 9/2007 | Banerjee et al. | |
| 2009/0044818 | A1 | 2/2009 | Takeuchi et al. | |
| 2010/0186757 | A1 | 7/2010 | Crooks et al. | |
| 2010/0252057 | A1 | 10/2010 | Saleh | |
| 2011/0271971 | A1 | 11/2011 | Conner et al. | |
| 2012/0042885 | A1 | 2/2012 | Stone et al. | |
| 2012/0067360 | A1 | 3/2012 | Conner et al. | |
| 2013/0019888 | A1 | 1/2013 | Tsuruizumi et al. | |
| 2013/0133675 | A1 | 5/2013 | Shinozaki et al. | |
| 2013/0146075 | A1 | 6/2013 | Poget et al. | |
| 2013/0233329 | A1 | 9/2013 | Sebastian et al. | |
| 2013/0269720 | A1 | 10/2013 | Stone et al. | |
| 2014/0326260 | A1 | 11/2014 | Gladden et al. | |
| 2017/0065000 | A1 * | 3/2017 | Sears | H05B 1/0288 |

FOREIGN PATENT DOCUMENTS

| | | | | |
|---|---|---|---|---|
| EP | 2 550 879 | | 1/2013 | |
| EP | 2 647 301 | | 10/2013 | |
| JP | S 57198080 | | 12/1982 | |
| WO | WO 2011139730 | A1 * | 11/2011 | A24B 15/165 |
| WO | WO 2012/164077 | | 12/2012 | |
| WO | WO 2013/098380 | | 7/2013 | |
| WO | WO 2013/098405 | | 7/2013 | |
| WO | WO 2013/098410 | | 7/2013 | |
| WO | WO 2013/104914 | | 7/2013 | |
| WO | WO 2013/120849 | | 8/2013 | |
| WO | WO 2013/120854 | | 8/2013 | |
| WO | WO 2014/102070 | | 7/2014 | |
| WO | WO 2014102070 | A1 * | 7/2014 | A24B 15/284 |

* cited by examiner

HEAT GENERATION SEGMENT FOR AN AEROSOL-GENERATION SYSTEM OF A SMOKING ARTICLE

BACKGROUND OF THE DISCLOSURE

Field of the Disclosure

The present disclosure relates to products made or derived from tobacco, or that otherwise incorporate tobacco, and are intended for human consumption and, more particularly, to components and configurations of heat-not-burn smoking articles.

Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarettes is employed by a smoker by lighting one end thereof and burning the tobacco rod. The smoker then receives mainstream smoke into his/her mouth by drawing on the opposite end (e.g., the filter end or mouth end) of the cigarette. Through the years, efforts have been made to improve upon the components, construction and performance of smoking articles. See, for example, the background art discussed in U.S. Pat. Nos. 7,503,330 and 7,753,056, both to Borschke et al.; which are incorporated herein by reference.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette recently has been marketed in Japan by Japan Tobacco Inc. under the brand name "Steam Hot One." Furthermore, various types of smoking products incorporating carbonaceous fuel elements for heat generation and aerosol formation recently have been set forth in the patent literature. See, for example, the types of smoking products proposed in U.S. Pat. No. 7,836,897 to Borschke et al.; U.S. Pat. No. 8,469,035 to Banerjee et al. and U.S. Pat. No. 8,464,726 to Sebastian et al.; US Pat. Pub. Nos. 2012/0042885 to Stone et al.; 2013/0019888 to Tsuruizumi et al; 2013/0133675 to Shinozaki et al. and 2013/0146075 to Poget et al.; PCT WO Nos. 2012/0164077 to Gladden et al.; 2013/098380 to Raether et al.; 2013/098405 to Zuber et al.; 2013/098410 to Zuber et al.; 2013/104914 to Woodcock; 2013/120849 to Roudier et al.; 2013/120854 to Mironov; EP 1808087 to Baba et al. and EP 2550879 to Tsuruizumi et al.; which are incorporated by reference herein in their entirety. A historical perspective of technology related to various types of smoking products incorporating carbonaceous fuel elements for heat generation and aerosol formation may be found, for example, in the Background of US Pat. Pub. No. 2007/0215167 to Llewellyn Crooks et al., which is also incorporated herein by reference.

It would be highly desirable to provide smoking articles that demonstrate the ability to provide to a smoker many of the benefits and advantages of conventional cigarette smoking, without delivering considerable quantities of incomplete combustion and pyrolysis products. In conjunction with such desirable characteristics, it would also be desirable for a direct ignition smoking article to be readily ignited, and to remain ignited, while being used by the smoker.

BRIEF SUMMARY OF THE DISCLOSURE

The above and other needs are met by aspects of the present disclosure which, in one aspect, provides an elongate smoking article having a lighting end and an opposed mouth end. Such a smoking article comprises a mouth end portion disposed at the mouth end, and optionally includes a tobacco portion disposed between the lighting end and the mouth end portion. An aerosol-generation system is disposed between the lighting end and the mouth end portion, wherein the aerosol-generation system including a heat generation portion disposed at the lighting end, which includes a combustible fuel element.

In one aspect of the invention, a combustible fuel element adapted for use in a smoking article is provided, the fuel element comprising a combustible carbonaceous material in an amount of at least 25% by dry weight, based on the weight of the fuel element, and a particulate ignition aid dispersed throughout the fuel element and selected from the group consisting of ceramic particles, cellulose particles, fullerenes, impregnated activated carbon particles, inorganic salts, and combinations thereof, wherein the average particle size of the ignition aid is less than about 1,000 microns and with the proviso that when the ignition aid is an inorganic salt, the inorganic salt is present in an amount of no more than about 0.5 dry weight percent based on the total dry weight of the fuel element. The particulate ignition aid is advantageously non-catalytic. Exemplary impregnating agents for the activated carbon include metals, metal oxides, inorganic salts, and mineral acids. The ignition aid enhances the operation of the fuel element by reducing the amount of time required to ignite the fuel element.

In certain embodiments, the ignition aid comprises ceramic particles or cellulose particles having an average particle size of less than about 500 microns, the ceramic particles, being glass bubbles or cenospheres. For example, the ignition aid can include glass bubbles having an average particle size of about 10 to about 300 microns. Alternatively, the ignition aid can include cellulose particles having an average particle size of about 10 to about 300 microns. In certain embodiments, the ceramic particles of the ignition aid are metal-coated ceramic particles. In certain embodiments, the presence of the ignition aid reduces the time required to ignite the fuel element by at least 20% as compared to a control fuel element devoid of the ignition aid.

The fuel element may include further ingredients, such as a binding agent, a catalytic metal material, graphite, an inorganic filler, and combinations thereof. In one embodiment, the fuel element comprises at least about 30% by dry weight of the combustible carbonaceous material, based on the dry weight of the fuel element; between about 0.1% and about 20% by dry weight of the ignition aid; at least about 5% by dry weight of a binding agent (e.g., natural gums such as guar gum); at least about 5% by dry weight of graphite; and at least about 25% by dry weight of an inorganic filler (e.g., calcium carbonate).

In another aspect, the invention provides an elongate smoking article having a lighting end and an opposed mouth end, the smoking article comprising: a mouth end portion disposed at the mouth end; a tobacco portion disposed between the lighting end and the mouth end portion; and an aerosol-generation system disposed between the lighting end and the tobacco portion, the aerosol-generation system including a heat generation portion disposed at the lighting end, the heat generation portion comprising a fuel element according to any of the embodiments set forth above and configured to be actuated by ignition of the lighting end.

In one particular embodiment, the invention provides an elongate smoking article having a lighting end and an opposed mouth end, said smoking article comprising:

a mouth end portion disposed at the mouth end;

a tobacco portion disposed between the lighting end and the mouth end portion; and an aerosol-generation system disposed between the lighting end and the tobacco portion, the aerosol-generation system including a heat generation portion disposed at the lighting end, the heat generation portion comprising a fuel element configured ignition of the lighting end, the fuel element comprising:

(a) at least about 30% by dry weight of the combustible carbonaceous material, based on the dry weight of the fuel element;

(b) about 0.1% to about 20% by dry weight of a non-catalytic ignition aid comprising ceramic particles or cellulose particles having an average particle size of less than about 500 microns, the ceramic particles being glass bubbles or cenospheres;

(c) at least about 5% by dry weight of a binding agent;

(d) at least about 5% by dry weight of graphite; and (e) at least about 25% by dry weight of an inorganic filler.

In yet another aspect of the invention, an elongate smoking article having a lighting end and an opposed mouth end is provided, the smoking article comprising: a mouth end portion disposed at the mouth end (e.g., a filter element); and an aerosol-generation system disposed between the lighting end and the mouth end portion, the aerosol-generation system including a heat generation portion disposed at the lighting end, the heat generation portion comprising a fuel element configured for ignition of the lighting end, the fuel element comprising a combustible carbonaceous material in an amount of at least 25% by dry weight, based on the weight of the fuel element; and the aerosol-generation system including an aerosol-generating portion comprising a plurality of aerosol-generating elements in the form of beads or pellets comprising at least one aerosol forming material, wherein the aerosol-generating elements are smoke-treated. Exemplary bead or pellets are treated with wood smoke, such as smoke generated by a wood selected from hickory, maple, oak, apply, cherry, mesquite, and combinations thereof.

The aerosol-generating elements can further comprise one or more of particulate tobacco, a tobacco extract, and nicotine, wherein the nicotine in free base form, salt form, as a complex, or as a solvate. In addition, the aerosol-generating elements can further comprise one or more fillers, binders, flavorants, and combinations thereof. Exemplary aerosol forming materials include glycerin, propylene glycol, water, saline, nicotine, and combinations thereof.

Further features and advantages of the present disclosure are set forth in more detail in the following description.

BRIEF DESCRIPTION OF THE DRAWINGS

Figure 1:
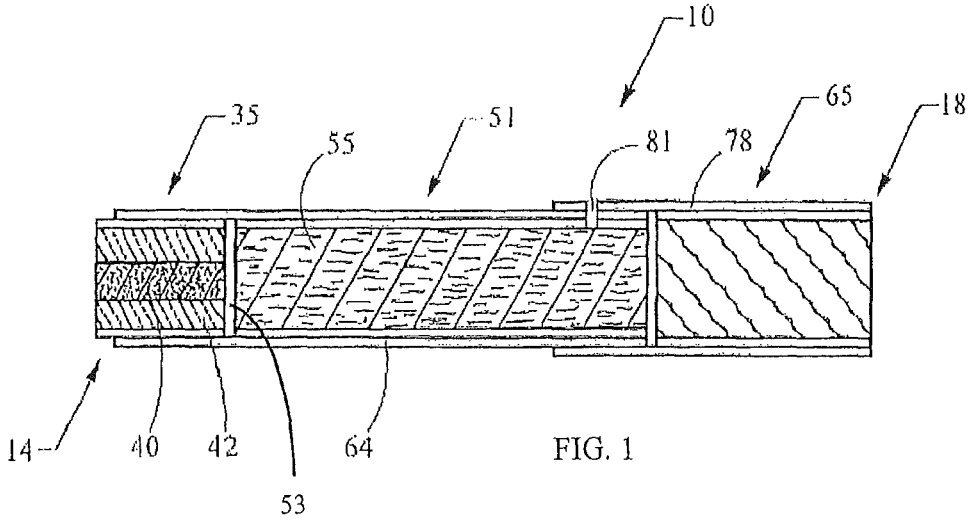
Figure 2:
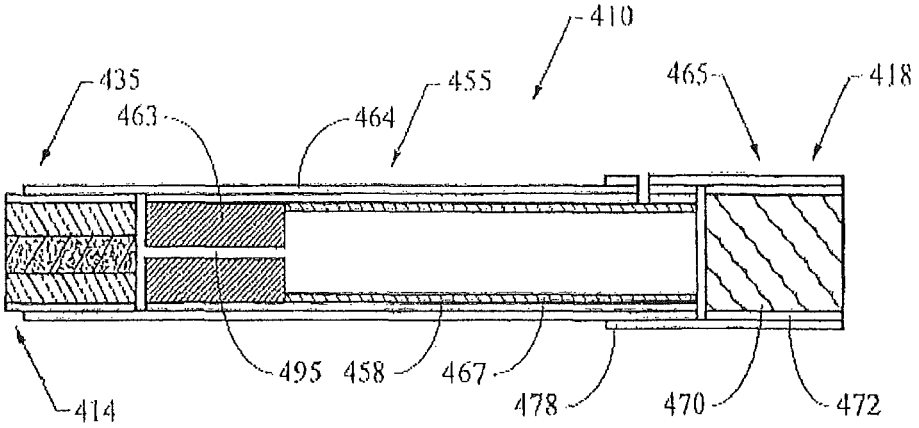
Figure 3:
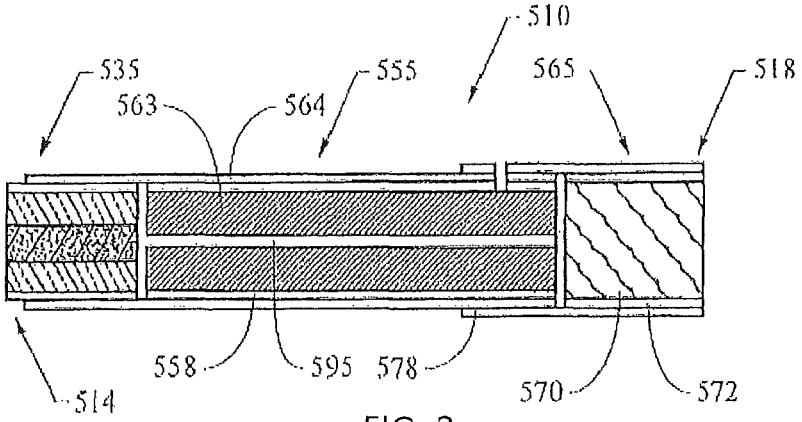
Figure 4:
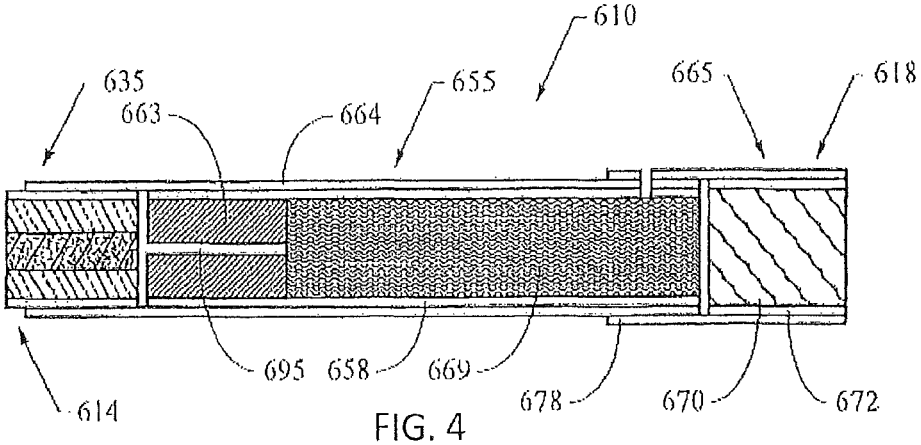
Figure 5:
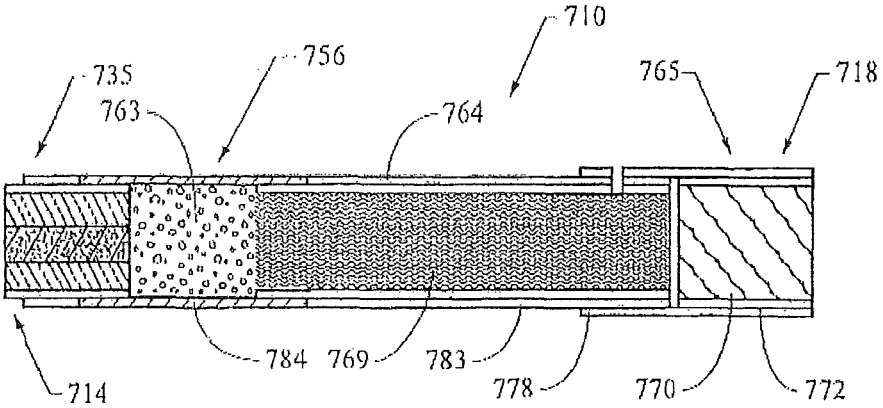
Figure 6:
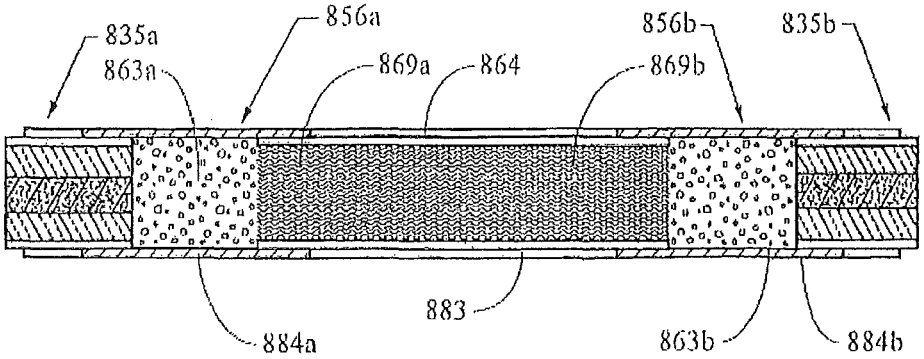

Having thus described the disclosure in general terms, reference will now be made to the accompanying drawings, which are not necessarily drawn to scale, and wherein:

FIG. 1 provides a longitudinal cross-sectional view of a representative smoking article;

FIGS. 2-4 each show a longitudinal cross-sectional view of a representative smoking article including a monolithic substrate;

FIG. 5 shows a longitudinal cross-sectional view of a representative smoking article including a tobacco pellet substrate; and FIG. 6 shows a two-up rod that may be used for manufacturing the smoking article of FIG. 5.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

The invention provides a combustible fuel element suitable for use in certain smoking articles adapted to heat, but not burn, tobacco. Such smoking articles are sometimes referred to as "heat-not-burn" tobacco products. The fuel elements of the invention include a combustible carbonaceous material, such as a milled carbon powder (e.g., BKO carbon powder). Such combustible carbonaceous materials generally have high carbon content, such as carbonaceous materials that can be characterized as comprised predominantly of carbon, typically having a carbon content of greater than about 60 percent, generally greater than about 70 percent, often greater than about 80 percent, and frequently greater than about 90 percent, on a dry weight basis. The amount of combustible carbonaceous material incorporated into a fuel element can vary, but is typically at least about 25 percent, often at least about 30 percent, and frequently at least about 35 percent, of the weight of a fuel element, on a dry weight basis. An exemplary weight range for the combustible carbonaceous material is about 25 dry weight percent to about 60 dry weight percent, more typically about 30 dry weight percent to about 50 dry weight percent.

In addition to the combustible carbonaceous material, the fuel element of the invention includes one or more ignition aids. As used herein, "ignition aid" refers to a component of the fuel element that reduces the time it takes to ignite the fuel element. Advantageously, the ignition aid is a non-catalytic material, meaning the ignition aid does not participate to any meaningful degree in catalytic reactions, particularly with respect to gas phase catalyzed reactions such as the catalyzed conversion of carbon monoxide to carbon dioxide. Exemplary ignition aids include ceramic materials, cellulose materials, fullerenes, impregnated activated carbon materials, and combinations thereof. Although not bound by any particular theory of operation, it is believed that the ignition aid reduces lightability time of a fuel element of the invention by either providing a lower ignition temperature as compared to the primary combustible carbonaceous material or increasing available surface area of the primary combustible carbonaceous material.

The presence of the ignition aid reduces the time required to ignite the fuel element, when using the lightability test set forth in the Experimental section of this application. As noted in the lightability test set forth herein, the goal is a self-sustaining ignition of the fuel element over a period of time, meaning the fuel element remains lit at least 20 seconds after contact with an open flame, as determined by subjecting a smoking article containing the fuel element to a puff and witnessing whether the puff causes the fuel element to glow orange or red, which would indicate strong combustion is taking place. In certain embodiments, smoking articles containing fuel elements that include ignition aids as set forth herein exhibit a lightability time of less than about 4.5 seconds, such as less than about 4.0 seconds or less than about 3.5 seconds. The reduction in lightability time can be characterized in terms of a percentage reduction as compared to a control fuel element devoid of the ignition aid (but otherwise essentially the same in composition). For example, in certain embodiments, smoking articles containing fuel elements that include ignition aids as set forth herein exhibit a lightability time as compared to a control smoking article that is at least 20% lower than the lightability time of the control smoking article, such as at least about 30% lower or at least about 40% lower.

The amount of ignition aid used in the fuel element can vary and will depend, in part, on the selection of the ignition aid, the formulation of the fuel element, and the desired ignition properties. Typically, the ignition aid will be present in an amount of at least about 0.01 percent by dry weight of the fuel element, more typically at least about 0.05 percent by dry weight, at least about 0.1 percent by dry weight, or at least about 0.5 percent by dry weight. The ignition aid will typically not be used in amounts exceeding about 40 percent by dry weight, such as less than about 30 percent by dry weight or less than about 25 percent by dry weight or less than about 20 percent by dry weight. Typically, the ignition aid will be present in an amount less than the combustible carbonaceous material. An advantageous range for the ignition aid is from about 0.01 dry weight percent to 20 dry weight percent, such as about 0.01 dry weigh percent to about 10 dry weight percent or about 0.01 dry weight percent to about 5 dry weight percent.

It has been surprisingly discovered that very low inclusion levels of the ignition aids noted herein and successfully reduce the lightability time of fuel elements of the invention. For example, in certain cases, ignition aids present in an amount of no more than about 5 dry weight percent (based on total weight of fuel element), particularly no more than about 2.5 dry weight percent or no more than about 1.0 dry weight percent. In some instances, the ignition aid can be present in any amount of no more than about 0.5 dry weight percent or no more than about 0.25 dry weight percent. In particular, it is noted that inorganic salts and ceramic materials can be used successfully at very low inclusion levels.

The ignition aid used in the present invention will typically be in a granular or particulate form (such granular or particulate materials being generically referred to herein as "particles"), and the particles of the ignition aid can be solid or hollow (e.g., particles containing a gas-filled cavity). The particle size can vary, but the particles are typically sized in a range that can be referred to as microparticles or nanoparticles. Exemplary ranges include microparticles having an average particle size of about 0.1 to about 1,000 microns, such as about 10 to about 300 microns (e.g., about 10 to about 50 microns). In one exemplary embodiment, the ignition aid is present in the form of microparticles having an average particle size of less than about 250 microns or less than about 200 microns or less than about 150 microns (e.g., about 20 to about 250 microns). Nanoparticle size ranges include particles having an average particle size of less than about 100 nm (e.g., about 50 to about 100 nm). The overall shape of the particles can vary without departing from the present invention, and some shapes can be characterized as irregular. In some embodiments, the particles can be substantially spherical in shape (e.g., microspheres).

Average primary particle size can be determined by visually examining a micrograph of a transmission electron microscopy ("TEM") image or a scanning electron microscopy ("SEM") image, measuring the diameter of the particles in the image, and calculating the average primary particle size of the measured particles based on magnification of the TEM or SEM image. The primary particle size of a particle refers to the smallest diameter sphere that will completely enclose the particle, and this measurement relates to an individual particle as opposed to an agglomeration of two or more particles. The above-noted size ranges are average values for particles having a distribution of sizes. It is also possible to use mixtures of particles having different average particle sizes within the ranges noted herein (e.g., bimodal particle distributions). In certain embodiments, commercially available materials can be purchases and ground to the desired size using equipment known in the art, such as bead mills, ball mills, hammer mills, and the like.

In certain embodiments, the ignition aid is in the form of ceramic particles, preferably in a size range of about 1,000 microns or less. Such ceramic particles are understood to include inorganic metal-containing (including metalloid-containing) oxide (e.g., alumina, silica, iron oxide, ceria, zirconia, and the like) or nonoxide (e.g., carbide, boride, nitride, and the like) particles that are noncombustible at the combustion temperatures of the fuel element. In one embodiment, the ceramic particles are glass bubbles, sometimes referred to as microballoons or glass microspheres, which are hollow glass particles. Exemplary glass bubble materials include those materials marketed by 3M as the 3M™ Glass Bubble Series such as the K20, S35, XLD3000 and XLD6000 materials. Other ceramic particulate materials include those marketed as 3M™ Ceramic Microspheres (e.g., W-210, W-410, or W-610) and the inert ceramic materials marketed by Tipton Corporation as Ceramic Balls (e.g., BSS18) or High Alumina Balls (e.g., BSS99). In a further embodiment, the ceramic particles are cenospheres, which are understood to be hollow spheres formed largely of silica and alumina and produced as a byproduct of coal combustion. See, for example, the cenospheres available from CenoStar Corporation or the cenospheres available from Omya UK Ltd. under the tradename Fillite®. Optionally, the ceramic particles can be metal-coated using metals such as nickel, iron, copper, tin, silver, and gold. Exemplary metal-coated ceramics are available from Federal Technology Group of Bozeman, Mont. or Accumet Materials Company of Ossining, N.Y. Although not bound by any particular theory of operation, it is believed that ceramic particles can aid ignition of the fuel element (i.e., reduce the time it takes to light the fuel element) by increasing the surface area of the combustible carbonaceous material in the fuel element.

In another embodiment, the ignition aid is in the form of cellulose particles (e.g., made from cotton linters) such as cellulose particles available from Sigma-Aldrich under the tradename SIGMACELL. Such cellulose materials are typically microparticles within the particle size ranges set forth above. Although not bound by any particular theory of operation, it is believed that the addition of combustible cellulose material aids ignition of the fuel element because such materials have an ignition temperature below that of the combustible carbonaceous material of the fuel element referenced above.

In another embodiment, the ignition aid is a fullerene, which is understood to refer to allotropes of carbon atoms that are typically in the shape of spheres, ellipsoids, or tubes, specifically including carbon nanotubes.

In still further embodiments, the ignition aid is an impregnated activated carbon particulate material. Exemplary activated carbon materials are impregnated with metals (e.g., Ag or Mg), metal oxides (e.g., ZnO, CaO, $Al_2O_3$, MgO, CuO, Cu/CrO, $Fe_2O_3$), inorganic salts (e.g., NaOH, KOH, KI, $KMnO_4$, $K_2CO_3$ and $Na_2CO_3$), mineral acids (e.g., $H_2SO_4$ or $H_3PO_4$) and the like. One source for such materials is Calgon Corporation. Such impregnated carbon materials are typically microparticles within the particle size ranges set forth above. Although not bound by any particular theory of operation, it is believed that the addition of impregnated carbon materials aids ignition of the fuel element because such materials have an ignition temperature below that of the combustible carbonaceous material of the fuel element referenced above.

The lightability aid could also be in the form of inorganic salts such as various alkali metal or alkaline earth metal salts, typically in the form of oxides, halides, or sulfates (including bisulfates). Examples include sodium chloride, sodium sulfate, magnesium chloride, magnesium sulfate, calcium chloride, calcium sulfate, potassium chloride, potassium sulfate, sodium bisulfate, and the like.

The fuel element will typically also include a binding agent to enhance the cohesiveness of the composition. Exemplary binding agents include natural gums (e.g., guar gum) or alginate materials (e.g., ammonium alginate or sodium alginate). The binding agent is typically present in an amount of about 5 percent by dry weight of the fuel element to about 25 percent by dry weight (e.g., about 7.5 to about 15 percent by dry weight).

The fuel element composition of the present invention can also include graphite in addition to the primary carbonaceous material referenced above. For example, the fuel composition described above can further comprise at least about 2 dry weight percent, at least about 5 dry weight percent, or at least about 7.5 dry weight percent powdered graphite, based on the dry weight of the fuel element. Typically, the amount of graphite added to the fuel element composition does not exceed about 20 dry weight percent. The graphite is typically added in a powdered form having an average particle size of less than about 50 microns.

The fuel element composition can further comprise an inorganic filler, such as calcium carbonate or sodium carbonate. Typical amounts of such inorganic fillers include at least about 1 dry weight percent, at least about 5 dry weight percent, or at least about 10 dry weight percent, based on the dry weight of the fuel element. Typically, the amount of inorganic filler added to the fuel element composition does not exceed about 40 dry weight percent, and most often is less than about 35 dry weight percent.

The fuel element composition may also include a catalytic metal material, which can reduce the concentration of certain gaseous components of mainstream smoke generated during use of a smoking article incorporating the fuel element. As used herein, "catalytic metal material" refers to elemental metal or a metal-containing compound that can either directly react with one or more gas phase components of mainstream smoke generated by a smoking article or catalyze a reaction involving a gas phase component of mainstream smoke or both, such that concentration of the gas phase component is reduced. For example, certain catalytic metal materials can catalyze the oxidation of CO to $CO_2$ in the presence of oxygen in order to reduce the level of CO in mainstream smoke (i.e., oxidation catalysts). In US 2007/0215168 to Banerjee et al., which is incorporated by reference herein in its entirety, smoking articles comprising fuel elements treated with cerium oxide particles are described. The cerium oxide particles reduce the amount of carbon monoxide emitted during use of smoking articles incorporating the treated fuel elements. Additional catalytic metal compounds are described in U.S. Pat. No. 6,503,475 to McCormick; U.S. Pat. No. 6,503,475 to McCormick; U.S. Pat. No. 7,011,096 to Li et al.; and U.S. Pat. No. 8,617,263 to Banerjee et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; and 2005/0274390 to Banerjee et al., which are also incorporated by reference herein in their entirety.

Examples of the metal component of the catalytic metal material include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn. Catalytic metal materials can be used in a variety of solid particulate forms including precipitated metal particles, metal oxide particles (e.g., iron oxides, copper oxide, zinc oxide, and cerium oxide), and supported catalyst particles wherein the catalytic metal compound is dispersed within a porous supporting material. Combinations of catalytic metal materials can be used, such as a combination of a palladium catalyst with cerium oxide. The particle size of the catalytic metal materials can vary, but is typically about 1 nm to about 10 microns. The amount of catalytic metal material used can vary, but is typically in an amount of at least about 2.5 dry weight percent, at least about 5 dry weight percent, or at least about 10 dry weight percent, based on the dry weight of the fuel element. The catalytic metal material is typically present in an amount of less than about 35 dry weight percent, more often less than about 30 dry weight percent or less than about 25 dry weight percent.

In addition to the above-noted components, the combustible fuel element of the invention can incorporate tobacco components (e.g., powdered tobacco or tobacco extract); flavoring agents; or ammonia sources such as ammonia salts. These types of components are typically used in amounts of less than about 10 dry weight percent, and often less than about 5 dry weight percent, based on the dry weight of the fuel element.

The various components of the fuel element composition may be contacted, combined, or mixed together in conical-type blenders, mixing drums, ribbon blenders, or the like, such as a Hobart mixer. As such, the overall mixture of various components may, in some embodiments, be relatively uniform in nature. In particular, it is advantageous for the ignition aid to be dispersed throughout the fuel element composition in a substantially uniform manner. Upon mixing, the fuel element composition is typically in the form of a moist, dough-like paste. Thereafter, the fuel element can be formed into the desired shape by techniques such as compression, pressing, or extrusion. For example, the composition can be extruded using single screw or twin screw extruder. Exemplary types of extrusion devices include those types available as ICMA San Giorgio Model No. 70-16D or as Welding Engineers Model No. 70-16LD. For an extruded fuel element containing a relatively high level of carbonaceous material, the density of the fuel element can be decreased slightly by increasing the moisture level within the extruded mixture, decreasing the die pressure within the extruder, or incorporating relatively low density materials within the extruded mixture.

Alternatively, the fuel element can be formed using a foamed carbon monolith structure as the primary carbonaceous material, such as a carbon monolith formed using a foam process of the type disclosed in U.S. Pat. App. Pub. No. 2008/0233294 to Lobovsky, which is incorporated herein by reference. Various additional components, such as the ignition aid, can be incorporated into the monolith structure using known techniques such as spray-coating or dip-coating the monolith structure.

A representative fuel element, for example, has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel elements, representative components, designs and configurations thereof, and manners and methods for producing those fuel elements and the components thereof, set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,461,879 to Barnes et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; U.S. Pat. No. 5,727,571 to Meiring et al.; U.S. Pat. No. 7,836,897 to Borschke et al.; U.S. Pat. No. 8,469,035 to Banerjee et al.; and U.S. Pat. App. Pub. Nos. 2005/0274390 to Banerjee et al.; 2007/0215167 to Crooks et al.; 2007/0215168 to Banerjee et al.; 2012/0042885 to Stone et al.; and 2013/0269720 to Stone et al.; and U.S. application Ser. No. 14/036,536 to Conner et al. filed Sep. 25, 2013, which are incorporated herein by reference.

The fuel element prepared according to the method of the invention can be utilized in a variety of smoking articles, such as any of the smoking articles set forth in US 2007/0215167 to Crooks et al. or US 2007/0215168 to Banerjee et al., which are incorporated by reference herein. Exemplary smoking article construction may include features such as fibrous filter elements, foamed ceramic monoliths formed as insulators, and other features disclosed in U.S. Pat. No. 8,464,726 and U.S. Pat. Pub. No. 2013/0233329; both to Sebastian et al., which are incorporated herein by reference. Representative types of smoking articles that can utilize the fuel elements of the invention are set forth in FIGS. 1 through 6. The fuel element is referred to as a heat source in the accompanying drawings and forms part of the heat generation segment of the smoking article.

FIG. 1 illustrates a representative smoking article 10 in the form of a cigarette. The smoking article 10 has a rod-like shape, and includes a lighting end 14 and a mouth end 18. At the lighting end 14 is positioned a longitudinally-extending, generally cylindrical, heat generation segment 35. The heat generation segment 35 includes a heat source 40 circumscribed by insulation 42, which may be coaxially encircled by wrapping material 45. The heat source 40 preferably is configured to be activated by direct ignition of the lighting end 14. The smoking article 10 also includes a filter segment 65 located at the other end (mouth end 18), and an aerosol-generating segment 51 (which may incorporate tobacco) that is located in between those two segments.

Another embodiment of a fuel element 40 may include a foamed carbon monolith formed in a foam process. In another embodiment, the fuel element 40 may be co-extruded with a layer of insulation 42, thereby reducing manufacturing time and expense. Still other embodiments of fuel elements may include those of the types described in U.S. Pat. No. 4,819,655 to Roberts et al. or U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat of non-woven glass filaments, an intermediate layer of reconstituted tobacco paper, and an outer layer of non-woven glass filaments. These may be concentrically oriented or each overwrapping and/or circumscribing the heat source. Various other insulation embodiments may be molded, extruded, foamed, or otherwise formed. Particular embodiments of insulation structures may include those described in U.S. Pat. App. Pub. No. 2012/0042885 to Stone et al., which is incorporated by reference herein in its entirety.

Preferably, both ends of the heat generation segment 35 are open to expose at least the heat source 40 and insulation 42 at the lighting end 14. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, heat and/or heated air produced when the lighting end 14 is ignited during use of the smoking article 10 can readily pass through the heat generation segment 35 during draw by the smoker on the mouth end 18.

The heat generation segment 35 preferably is positioned with one end disposed at the lighting end 14, and is axially aligned in an end-to-end relationship with a downstream aerosol-generating segment 51, preferably abutting one another, but with no barrier (other than open air-space) therebetween. The close proximity of the heat generation segment 35 to the lighting end 14 provides for direct ignition of the heat source/fuel element 40 of the heat generation segment 35.

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

A longitudinally extending, cylindrical aerosol-generating segment 51 is located downstream from the heat generation segment 35. The aerosol-generating segment 51 includes a substrate material 55 that, in turn, acts as a carrier for an aerosol-forming agent or material (not shown). For example, the aerosol-generating segment 51 can include a reconstituted tobacco material that includes processing aids, flavoring agents, and glycerin. The foregoing components of the aerosol-generating segment 51 can be disposed within, and circumscribed by, a wrapping material. The wrapping material can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51. Particular embodiments of substrates may include those described below or those described in U.S. Pat. App. Pub. No. 2012/0042885 to Stone et al., which is incorporated by reference herein in its entirety.

A representative wrapping material for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm up to about 21 mm. The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. Certain cast sheet constructions may include about 270 to about 300 mg of tobacco per 10 mm of linear length. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material of the aerosol-generating segment 51 can act as a carrier for aerosol-forming material and/or at least one flavoring agent.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment. In these and/or other embodiments, the substrate 55 may include pellets or beads formed from marumarized and/or non-marumarized tobacco. Marumarized tobacco is known, for example, from U.S. Pat. No. 5,105,831 to Banerjee, et al., which is incorporated herein by reference. Marumarized tobacco may include, for example, about 20 to about 50 percent (by weight) tobacco blend in powder form, with glycerol (at about 20 to about 30 percent by weight), calcium carbonate (generally at about 10 to about 60 percent by weight, often at about 40 to about 60 percent by weight), along with binder and flavoring agents. The binder may include, for example, a carboxymethyl cellulose (CMC), gum (e.g., guar gum), xanthan, pullulan, and/or an alginate. The beads, pellets, or other marumarized forms may be constructed in dimensions appropriate to fitting within a substrate section and providing for optimal air flow and production of desirable aerosol. A container, such as a cavity or capsule, may be formed for retaining the substrate in place within the smoking article. Such a container may be beneficial to contain, for example, pellets or beads of marumarized and/or non-marumarized tobacco. The container may be formed using wrapping materials as further described below.

As noted above, the aerosol-generating segment 51 may include aerosol-generating material or elements that can be defined as beads, pellets, or other discrete small units of a composition typically including tobacco or some component thereof (e.g., marumarized and/or non-marumarized tobacco). Such pellets may have smooth, regular outer shapes (e.g., spheres, cylinders, ovoids, etc.) and/or they may have irregular outer shapes. In one example, the diameter of each pellet may range from less than about 1 mm to about 2 mm. The pellets may at least partially fill a substrate cavity of a smoking article as described herein. In one example, the volume of the substrate cavity may range from about 500 $mm^3$ to about 700 $mm^3$ (e.g., a substrate cavity of a smoking article where the cavity diameter is about 7.5 to about 7.8 mm, and the cavity length is about 11 to about 15 mm, with the cavity having a generally cylindrical geometry). In one example, the mass of the pellets within the substrate cavity may range from about 200 mg to about 500 mg.

In general, as used herein, the terms "pellets" and "beads" are meant to include beads, pellets, or other discrete small units or pieces of that may include (in addition to those otherwise disclosed herein), for example, carbon pieces, extruded carbon pieces cut into pellets, ceramic beads, marumarized tobacco pieces, and the like, or combinations thereof. For example, granules, pellets or beads can be generally cylindrical or spherical extruded or compressed granules, pellets or beads comprised of a moistened mixture or slurry of milled tobacco lamina, fillers (e.g., granular calcium carbonate), flavors, visible aerosol forming materials and binders (e.g., carboxy methylcellulose) that are formed, cut or spun to the desired size and shape, and then dried to retain the desired configuration. For example, some or all of the beads or pellets can comprise spherical capsules that are heat sensitive, so that when included in the aerosol-generating element and exposed to heat, the rupture or decomposition thereof causes the release of glycerin, propylene glycol, water, saline, tobacco flavor and/or nicotine or other substances or additives. Also, the beads can comprise ceramic or absorbent clay or silica or absorbent carbon to hold and release an aerosol former. Further, in some aspects, the beads/pellets may comprise a heat conductive material such as, for example, heat conductive graphite, heat conductive ceramic, a metal, tobacco cast on foil, a metal or other suitable material impregnated with appropriate aerosol-generating substances such as glycerin and flavor(s), or a suitable cast sheet material appropriately formed into the desired beads/pellets.

In one particular example, the beads/pellets (particles) may be comprised, by weight, of between about 15% and about 60% of finely milled tobacco particles (e.g., a blend of Oriental, burley and flue-cured tobaccos, essentially all Oriental tobacco, essentially all burley tobacco, or essentially all flue-cured tobacco), between about 15% and about 60% of finely milled particles of calcium carbonate (or finely milled clay or ceramic particles), between about 10% and about 50% of glycerol (and optionally a minor amount of flavors), between about 0.25% and about 15% of a binder (preferably carboxymethylcellulose, guar gum, potassium, or ammonium alginate), and between about 15% and about 50% of water. In another example, the beads/pellets (particles) may be comprised of about 30% of finely milled tobacco particles (e.g., a blend of Oriental, burley and flue-cured tobaccos, essentially all Oriental tobacco, essentially all burley tobacco, or essentially all flue-cured tobacco), about 30% of finely milled particles of calcium carbonate (or finely milled clay or ceramic particles), about 15% of glycerol (and optionally a minor amount of flavors), about 1% of a binder (preferably carboxymethylcellulose, guar gum, potassium, or ammonium alginate), and about 25% of water.

In such examples, the pellets may be compressed to hold the glycerol and, upon compression, may form a porous matrix that facilitates migration of the aerosol generating components to promote efficient aerosol formation. The manner by which the aerosol forming material is contacted with the substrate material can vary. The aerosol forming material can be applied to a formed material, can be incorporated into processed materials during manufacture of those materials, or can be endogenous to that material. Aerosol-forming material, such as glycerin, can be dissolved or dispersed in an aqueous liquid, or other suitable solvent or liquid carrier, and sprayed onto that substrate material. See, for example, U.S. Patent Appl. Pub. No. 2005/0066986 to Nestor et al. and 2012/0067360 to Conner et al.; which are incorporated herein by reference. The calcium carbonate or other inorganic filler assists in creating porosity within the particles, and may also function to absorb heat which may, in some instances limit or otherwise prevent scorching of the aerosol generating components, as well as assisting in and promoting aerosol formation. See also, for example, those types of materials set forth in U.S. Pat. No. 5,105,831 to Banerjee, et al., and U.S. Pat. App. Pub. Nos. 2004/0173229 to Crooks et al.; 2011/0271971 to Conner et al.; and 2012/0042885 to Stone et al.; which are incorporated herein by reference.

The tobacco-derived component of the beads or pellets can include highly purified tobacco-derived nicotine (e.g., pharmaceutical grade nicotine having a purity of greater than 98% or greater than 99%) or a derivative thereof can be used in the present invention. Representative nicotine-containing extracts can be provided using the techniques set forth in U.S. Pat. No. 5,159,942 to Brinkley et al., which is incorporated herein by reference. In certain embodiments, the products of the invention can include nicotine in any form from any source, whether tobacco-derived or synthetically-derived. Nicotinic compounds used in the products of the invention can include nicotine in free base form, salt form, as a complex, or as a solvate. See, for example, the discussion of nicotine in free base form in U.S. Pat. Pub. No. 2004/0191322 to Hansson, which is incorporated herein by reference. At least a portion of the nicotinic compound can be employed in the form of a resin complex of nicotine where nicotine is bound in an ion exchange resin such as nicotine polacrilex. See, for example, U.S. Pat. No. 3,901,248 to Lichtneckert et al.; which is incorporated herein by reference. At least a portion of the nicotine can be employed in the form of a salt. Salts of nicotine can be provided using the types of ingredients and techniques set forth in U.S. Pat. No. 2,033,909 to Cox et al. and Perfetti, Beitrage Tabakforschung Int., 12, 43-54 (1983). Additionally, salts of nicotine have been available from sources such as Pfaltz and Bauer, Inc. and K&K Laboratories, Division of ICN Biochemicals, Inc. Exemplary pharmaceutically acceptable nicotine salts include nicotine salts of tartrate (e.g., nicotine tartrate and nicotine bitartrate), chloride (e.g., nicotine hydrochloride and nicotine dihydrochloride), sulfate, perchlorate, ascorbate, fumarate, citrate, malate, lactate, aspartate, salicylate, tosylate, succinate, pyruvate, and the like; nicotine salt hydrates (e.g., nicotine zinc chloride monohydrate), and the like. In certain embodiments, at least a portion of the nicotinic compound is in the form of a salt with an organic acid moiety, including, but not limited to, levulinic acid as discussed in U.S. Pat. Pub. No. 2011/0268809 to Brinkley et al., which are incorporated herein by reference.

In one embodiment, the aerosol-generating materials discussed herein, such as those in the form of beads or pellets, can be smoke-treated to impart smoky flavor or aroma. For example, the beads or pellets can be prepared and then subjected to smoke from a combustible source, such as a wood source (e.g., wood selected from hickory, maple, oak, apply, cherry, or mesquite). The beads or pellets can be treated with the smoke for a time sufficient to impart the desired smoky flavor or aroma, with an exemplary time range being about 5 to about 45 minutes. The manner in which the beads or pellets are contacted with smoke can vary, with one example involving heating wood chips in a container until smoke is produced (e.g., heating wood chips to a temperature of about 350-400° F.) and placing the beads or pellets to be treated within a closed environment with the smoke produced by the wood chips.

In still other embodiments, the substrate 55 may be configured as a monolithic substrate, formed, for example, as described in U.S. Pat. App. Pub. No. 2012/0042885 to Stone et al., which is incorporated herein by reference in its entirety. The substrate may include or be constructed from an extruded material. The substrate also may be formed by press-fit or molding/casting. Thus, the generic term "monolithic substrate" may include a substrate formed by extrusion or by one of those other methods.

In some preferred smoking articles, both ends of the aerosol-generating segment 51 are open to expose the substrate material 55 thereof. Together, the heat generating segment 35 and the aerosol-generating segment 51 form an aerosol-generation system. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or it may be partially or substantially completely filled with a non-combustible material such as, for example, metal, organic, inorganic, ceramic, or polymeric materials, or any combination thereof. The buffer regions may be from about 1 mm to about 10 mm or more in thickness (length), but often will be about 2 mm to about 5 mm in thickness (length).

The components of the aerosol-generation system preferably are attached to one another, and secured in place using an overwrap material 64. For example, the overwrap material 64 can include a paper wrapping material or a laminated paper-type material that circumscribes each of the heat generation segment 35, and at least a portion of outer longitudinally extending surface of the aerosol-generating segment 51. The inner surface of the overwrap material 64 may be secured to the outer surfaces of the components it circumscribes by a suitable adhesive.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material that is overwrapped along the longitudinally extending surface thereof with circumscribing plug wrap material. In one example, the filter material includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system preferably is attached to the filter element 65 using tipping material 78. The smoking article 10 may include an air dilution means, such as a series of perforations 81, each of which may extend through the filter element tipping material 78 and plug wrap material in the manner shown, and/or which may extend to or into the substrate 55.

The filter element 65 may also include a crushable flavor capsule of the type described in U.S. Pat. No. 7,479,098 to Thomas et al. and U.S. Pat. No. 7,793,665 to Dube et al.; and U.S. Pat. No. 8,186,359 to Ademe et al., which are incorporated herein by reference in their entirety. Filters may include materials and may be manufactured by methods such as, for example, those disclosed in U.S. Pat. No. 7,740,019 to Nelson et al., U.S. Pat. No. 7,972,254 to Stokes et al., U.S. Pat. No. 8,375,958 to Hutchens et al.; and U.S. Pat. Publ. Nos. 2008/0142028 to Fagg, et al.; and 2009/0090372 to Thomas et al., each of which is incorporated herein by reference.

The overall dimensions of the smoking article 10, prior to burning, can vary. Typically, smoking articles 10 are cylindrically shaped rods having circumferences of about 20 mm to about 27 mm, have overall lengths of about 70 mm to about 130 mm—often about 83 mm to about 100 mm. The aerosol-generation system has an overall length that can vary from about 20 mm to about 65 mm. The heat generation segment 35 of the aerosol-generation system may have a length of about 5 mm to about 30 mm; and the aerosol-generating segment 51 of the aerosol-generation system may have an overall length of about 10 mm to about 60 mm.

The combined amount of aerosol-forming agent and substrate material 55 employed in the aerosol-generating segment 51 can vary. The material preferably may be employed so as to fill the appropriate section of the aerosol-generating segment 51 (e.g., the region within the wrapping material thereof) at a packing density of about 100 to about 400 $mg/cm^3$.

During use, the smoker lights the lighting end 14 of the smoking article 10 using a match or cigarette lighter, in a manner similar to the way that conventional smoking articles are lit, such that the heat source/fuel element 40 at the lighting end 14 is ignited. The mouth end 18 of the smoking article 10 is placed in the lips of the smoker. Thermal decomposition products (e.g., components of tobacco smoke) generated by the aerosol generation system are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Direct ignition actuates the fuel element 40 of the heat generation segment 35 such that it preferably will be ignited or otherwise activated (e.g., begin to burn). The heat source 40 within the aerosol-generation system will burn, and provide heat to volatilize aerosol-forming material within the aerosol-generating segment 51 as a result of the heat exchange relationship between those two segments. Certain preferred heat sources 40 will not experience volumetric decrease during activation, while others may degrade in a manner that reduces their volume. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed will be drawn through the filter element 65, and into the mouth of the smoker.

During certain periods of use, aerosol formed within the aerosol-generating segment 51 will be drawn through the filter element 65 and into the mouth of the smoker. Thus, the mainstream aerosol produced by the smoking article 10 includes tobacco smoke produced by the volatilized aerosol-forming material.

Flavor may be provided or enhanced by capsule or microcapsule materials on or within the substrate material 55 of the aerosol-generating segment 51, the wrapping materials, the filter element 65, or any other component capable of holding and releasing flavorants, preferably with minimal thermal degradation that would undesirably alter the flavor. Other flavor components associated with a filter may also be used; see, for example, U.S. Pat. No. 5,724,997 to Fagg, et al.

As noted above, the fuel element preferably will be circumscribed or otherwise jacketed by insulation, or other suitable material. The insulation can be configured and employed so as to support, maintain and retain the fuel element in place within the smoking article. The insulation may additionally be configured such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, I I I et al.; U.S. Pat. No. 5,546,965 to White; U.S. Pat. No. 5,727,571 to Meiring et al.; U.S. Pat. No. 5,902,431 to Wilkinson et al.; U.S. Pat. No. 5,944,025 to Cook et al.; U.S. Pat. No. 8,424,538 to Thomas et al.; and U.S. Pat. No. 8,464,726 to Sebastian et al.; which are incorporated herein by reference. Insulation assemblies have been incorporated within the types of cigarettes commercially marketed under the trade names "Premier" and "Eclipse" by R. J. Reynolds Tobacco Company, and as "Steam Hot One" cigarette marketed by Japan Tobacco Inc.

Flame/burn retardant materials and additives useful in insulation may include silica, carbon, ceramic, metallic fibers and/or particles. When treating cellulosic or other fibers such as—for example—cotton, boric acid or various organophosphate compounds may provide desirable flame-retardant properties. In addition, various organic or metallic nanoparticles may confer a desired property of flame-retardancy, as may diammonium phosphate and/or other salts. Other useful materials may include organo-phosphorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium chloride, ammonium borate, ethanolammonium borate, ammonium sulphamate, halogenated organic compounds, thio-urea, and antimony oxides may be used but are not preferred agents. In each embodiment of flame-retardant, burn-retardant, and/or scorch-retardant materials used in insulation, substrate material and other components (whether alone or in any combination with each other and/or other materials), the desirable properties most preferably are provided without undesirable off-gassing or melting-type behavior.

An insulation fabric preferably will have sufficient oxygen diffusion capability to sustain a smoking article such as a cigarette in a lit condition during a desired usage time. Accordingly the insulation fabric preferably will be porous by virtue of its construction. In knit, woven, or combined woven and knit constructions, the required porosity may be controlled by configuring the assembly machinery to leave sufficient (desirably sized) gaps between fibers to allow for oxygen diffusion into the heat source. For non-woven fabrics, which may not be porous enough to promote evenly sustained combustion, additional porosity may be achieved by perforations into the insulation by methods known in the art including, for example, hot or cold pin perforation, flame perforation, embossing, laser cutting, drilling, blade cutting, chemical perforation, punching, and other methods. Each of the buffer and the insulation may include non-glass material that is woven, knit, or a combination thereof, a foamed metal material, a foamed ceramic material, a foamed ceramic metal composite, and any combination thereof, and the material in the insulation may be the same as or different than that in the buffer.

The aerosol-forming material can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in U.S. Pat. App. Pub. No. 2007/0215167 to Llewellyn Crooks, et al., which is incorporated herein by reference in its entirety.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations (see, e.g., U.S. Pat. Pub. No. 2011/0271971 to Conner et al., which is incorporated herein by reference). The substrate material can be used in the form of a gathered web or sheet, using the types of techniques generally set forth in U.S. Pat. No. 4,807,809 to Pryor et al, which is incorporated herein by reference in its entirety. The substrate material can be used in the form of a web or sheet that is shredded into a plurality of longitudinally extending strands, using the types of techniques generally set forth in U.S. Pat. No. 5,025,814 to Raker, which is incorporated herein by reference in its entirety. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. See, for example, the types of components set forth in U.S. Pat. Publication 2004/0173229 to Crooks et al., which is incorporated herein by reference in its entirety.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al, which is incorporated herein by reference in its entirety. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials may incorporate relatively high levels of aerosol-forming material. Reconstituted tobaccos manufactured using paper-making types of processes may incorporate moderate levels of aerosol-forming material. Tobacco strip and tobacco cut filler can incorporate lower amounts of aerosol-forming material. Various paper and non-paper substrates including gathered, laminated, laminated metal/metallic, strips, beads such as alumina beads, open cell foam, foamed monolith, air permeable matrices, and other materials can be used within the scope of the disclosure. See, for example, U.S. Pat. Nos. 5,183,062; 5,203,355; and 5,588,446; each to Clearman, and each of which is incorporated herein by reference.

In other embodiments, the substrate portion of an aerosol-generation segment may include or may be constructed from an extruded or other monolithic material. An extruded substrate may be formed in the same manner as described herein with reference to other extruded components. The extruded or other monolithic substrate may include, or may be essentially comprised of, tobacco, glycerin, water, and binder material. In certain embodiments, a monolithic substrate may include about 10 to about 90 weight percent tobacco, about 5 to about 50 weight percent glycerin, about 1 to about 30 weight-percent water (before being dried and cut), and about 0 to about 10 weight percent binder. It may also include a filler such as, for example, calcium carbonate and/or graphite.

Following extrusion, drying, and cutting to a desired length, the substrate may be assembled into a segmented smoking article such as an Eclipse-type cigarette using a manual assembly method or a cigarette-making machine (e.g., KDF or Protus by Hauni Maschinenbau AG). Smaller diameter monolithic substrate elements may be combined by being wrapped, adhered, or otherwise assembled together for use in a smoking article as described for other substrate embodiments herein. Preferred substrate wraps include foil paper, heavy-gauge paper, plug wrap, and/or cigarette paper.

Cigarettes described with reference to FIG. 1 may be used in much the same manner as those cigarettes commercially marketed under the trade name "Eclipse" by R. J. Reynolds Tobacco Company. See also the "Steam Hot One" cigarette marketed by Japan Tobacco Inc.

In one embodiment, a smoking article may be constructed with a monolithic substrate 463, described here with reference to FIG. 2, which is a longitudinal section view of a cigarette 410 having a lighting end 414 and a mouth end 418. The monolithic substrate 463 (which may be used in other embodiments such as, for example, those discussed with reference to FIG. 1) may be formed by any appropriate extrusion method and is shown with a center-hole 495 extending longitudinally therethrough. The monolithic substrate, cut to length may comprise about 1/16 to about 5/8 of the total length of the cigarette, often about 1/10 to about 1/2 thereof (e.g., a 10 mm, 12 mm, or 50 mm long substrate element in an 85 mm or 130 mm long cigarette). The substrate segment 455 of the cigarette body includes a hollow spacing tube 467 disposed between the substrate 463 and the filter 470. The filter 470 is shown as constructed with overlying layers of plug wrap 472 and tipping paper 478. The substrate 463 and tube 467 are surrounded by a wrapping material 458, which may be configured—for example—as a heat-conducting material (e.g., foil paper), heavy-gauge paper, plug wrap, or cigarette paper. A cylindrically-encompassing wrapping material 464 (such as, for example, cigarette paper or heavy-gauge paper) may be provided to connect the heat-generation segment 435, central substrate segment 455, and filter segment 465. The heat-generation segment 435 and other components may be constructed as described herein and elsewhere in this and other embodiments configured to be practiced within the scope of the present disclosure.

In another embodiment, a smoking article may be constructed with an elongate monolithic substrate 563, described here with reference to FIG. 3, which is a longitudinal section view of a cigarette 510 having a lighting end 514 and a mouth end 518. The elongate monolithic substrate 563 (which may be used in other embodiments) may be formed by any appropriate extrusion method and is shown with a center-hole 595 extending longitudinally therethrough. The filter 570 is shown as constructed with overlying layers of plug wrap 572 and tipping paper 578. The substrate 563 is surrounded by a wrapping material 558, which may be configured—for example—as a heat-conducting material (e.g., foil paper), heavy-gauge paper, plug wrap, or cigarette paper. A cylindrically-encompassing wrapping material 564 (such as, for example, cigarette paper or heavy-gauge paper) may be provided to connect the heat-generation segment 535, central substrate segment 555 (consisting essentially of the substrate in this embodiment), and filter segment 565. The heat-generation segment 535 and other components may be constructed as described herein and elsewhere in this and other embodiments configured to be practiced within the scope of the present disclosure.

In one embodiment, a smoking article may be constructed with a monolithic substrate 663, described here with reference to FIG. 4, which is a longitudinal section view of a cigarette 610 having a lighting end 614 and a mouth end 618. The monolithic substrate 663 (which may be used in other embodiments) may be formed by any appropriate extrusion method and is shown with a center-hole 695 extending longitudinally therethrough. The cigarette body includes a tobacco rod 669 disposed between the substrate 663 and the filter 670. The filter 670 is shown as constructed with overlying layers of plug wrap 672 and tipping paper 678. The substrate segment 655, formed by the substrate 663 and tobacco rod 669, is surrounded by a wrapping material 658, which may be configured—for example—as a heat-conducting material (e.g., foil paper), heavy-gauge paper, plug wrap, or cigarette paper. A cylindrically-encompassing wrapping material 664 (such as, for example, cigarette paper or heavy-gauge paper) may be provided to connect the heat-generation segment 635, central substrate segment 655, and filter segment 665. The heat-generation segment 635 and other components may be constructed as described herein and elsewhere in this and other embodiments configured to be practiced within the scope of the present disclosure.

In another embodiment, a smoking article may be constructed with a substrate 763 in the form of beads or pellets as noted above, described here with reference to FIG. 5, which is a longitudinal section view of a cigarette 710 having a lighting end 714 and a mouth end 718. The substrate 763 (which may be used in other embodiments) may be formed by any appropriate method, such as a marumarization method noted above. The cigarette body includes a tobacco rod 769 disposed between the substrate 763 and the filter 770. The filter 770 is shown as constructed with overlying layers of plug wrap 772 and tipping paper 778. The heat-generation segment 735 and other components may be constructed as described herein and elsewhere in this and other embodiments configured to be practiced within the scope of the present disclosure.

The substrate 763 may be contained within a substrate cavity 756 (see, e.g., U.S. Pat. Pub. No. 2012/0067360 to Conner et al., which is incorporated herein by reference). The substrate cavity 756 may be formed by the heat-generation segment 735 at one end, the tobacco rod 769 at the opposite end, and a wrapping material 764 around the circumference of at least the substrate (and—in some embodiments—extending along an entire length from the filter to the lighting end). A cylindrical container structure (not shown) may circumferentially encompass the substrate cavity 756 within the wrapping material 764 and between the heat-generation segment 735 at one end and the tobacco rod 769 at the opposite end. The heat-generation segment 735 and the tobacco rod 769 may be joined to one another by the wrapping material 764. To that end, the wrapping material 764 may circumscribe at least a downstream portion of the heat-generation segment 735 and at least an upstream portion of the tobacco rod 769. The heat-generation segment 735 and the tobacco rod 769 may be spaced longitudinally from one another. In other words, the heat-generation segment 735 and the tobacco rod 769 may not be in abutting contact with one another. The substrate cavity 756 may be defined by a space extending longitudinally within the wrapping material 764 between the downstream end of the heat-generation segment 735 and the upstream end of the tobacco rod 769 as shown in FIG. 5. The substrate 763 may be positioned within the substrate cavity 756. For example, the substrate cavity 756 may be at least partially filled with tobacco pellets. The substrate cavity 756 may contain the substrate 763 to prevent migration of the tobacco pellets.

The wrapping material 764 may be configured, for example, as a heat-conducting material (e.g., foil paper), insulating material, heavy-gauge paper, plug wrap, cigarette paper, tobacco paper, or any combination thereof. Additionally, or alternatively, the wrapping material 764 may include foil, ceramic, ceramic paper, carbon felt, glass mat, or any combination thereof. Other wrapping materials known or developed in the art may be used alone or in combination with one or more of these wrapping materials. In one embodiment, the wrapping material 764 may include a paper material having strips or patches of foil laminated thereto. The wrapping material 764 may include a paper sheet 783. The paper sheet 783 may be sized and shaped to circumscribe the heat-generation segment 735, the substrate cavity 756, and the tobacco rod 769 as described above. To that end, the paper sheet 783 may be substantially rectangular in shape with a length extending along the longitudinal direction of the smoking article and a width extending in a direction transverse to the longitudinal direction. The width of the paper sheet 783 may be slightly larger than the circumference of the smoking article 710 so that the paper sheet may be formed into a tube or a column defining an outer surface of the smoking article. For example, the width of the paper sheet 783 may be from about 18 to about 29 mm. The length of the paper sheet 783 may be sufficient to extend longitudinally along an entire length of the substrate cavity 764 and to overlap the heat-generation segment 735 and the tobacco rod 769. For example, the length of the paper sheet 783 may be about 50 to about 66 mm. The paper sheet 783 may have a length sufficient to overlap substantially an entire length of the tobacco rod 769 as shown in FIG. 5. In one example, the paper sheet (or other wrapping material) may have a thickness of about 1 mil to about 6 mil (about 0.025 mm to about 0.15 mm).

A foil strip or patch 784 may be laminated to the paper sheet 783 to form a laminated coated region. The foil strip 784 may have a width extending along substantially the entire width of the paper sheet 783 to circumscribe substantially the entire circumference of the heat-generation segment 735, the substrate cavity 764, and the tobacco rod 769 as further described below. The foil strip 784 also may have a length extending along a portion of the length of the paper sheet 783. Preferably, the foil strip 784 may extend along a sufficient portion of the length of the paper sheet 783 such that the foil strip extends along the entire length of the substrate cavity 756 and overlaps at least a portion of the heat-generation segment 735 and the tobacco rod 769. For example, the length of the foil strip 784 may be from about 16 to about 20 mm. In one example, the foil strip may have a thickness of about 0.0005 mm to about 0.05 mm.

An intermediate segment of a smoking article may include a heat-generation segment, a substrate segment (e.g., a monolithic substrate or a substrate cavity including pellets or beads of substrate material), and a tobacco rod. It may be desirable to provide such an intermediate segment from so-called "two-up" rods that may be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; U.S. Pat. No. 6,229,115 to Vos et al.; U.S. Pat. No. 7,434,585 to Holmes; and U.S. Pat. No. 7,296,578 to Read, Jr.; and U.S. Pat. Appl. Pub. No. 2006/0169295 to Draghetti, each of which is incorporated by reference herein.

For example, FIG. 6 illustrates a two-up rod that may be produced in the process of manufacturing a smoking article 710 of FIG. 5, or other smoking article described herein. The two-up rod may include two intermediate segments as described above, the intermediate segments being joined to one another at a common tobacco rod. The two-up rod may include two heat-generation segments 835*a*, 835*b* positioned at opposite longitudinal ends thereof. A tobacco rod 869 may be substantially centered along the longitudinal axis of the rod. The tobacco rod 869 may include two portions 869*a*, 869*b* each associated with one intermediate segment. The tobacco rod 869 and the two heat-generation segments 835*a*, 835*b* may be joined to one another with wrapping material 864 as described above with reference to FIG. 5. A substrate cavity 856*a* may be defined within the wrapping material 864 between the heat-generation segment 835*a* and the tobacco rod 869. A substrate 863*a* may be contained within the substrate cavity 856*a*. Likewise, a substrate cavity 856*b* may be defined within the wrapping material 864 between the heat-generation segment 835*b* and the tobacco rod 869. A substrate 863*b* may be contained within the substrate cavity 856*b*. The wrapping material 864 may include a paper sheet 883 with foil strips 884*a*, 884*b* laminated thereto. The foil strips may be generally aligned with the substrate cavities as described above with reference to FIG. 5. The rod may be severed at about its longitudinal center to form two intermediate segments, each generally configured as described above. A tobacco rod, a hollow tube, and/or a filter element may be attached to the downstream end of each intermediate segment by any means to form a smoking article as described above. The method may include providing the wrapping material circumscribing at least a portion of the heat generation segment, the substrate cavity, the tobacco rod, the second substrate cavity, and at least a portion of the second heat generation segment, a second foil strip of the wrapping material circumscribing the second substrate cavity, wherein the foil strip and the second foil strip are registered at a discrete interval apart from each other, said interval calibrated to accurately and repeatably dispose the foil strip and the second foil strip at a desired location relative to the substrate cavity, the second substrate cavity, the heat generation segment, and the second heat generation segment.

Such a two-up rod and/or an intermediate segment may facilitate handling of the substrate material during manufacturing of a smoking article. For example, a two-up rod and/or an intermediate segment may be processed using standard processing equipment as described above while retaining the tobacco pellets substrate 863 between the heat generation segment 835 and the tobacco rod 869 and within the substrate cavity 856. In other words, the tobacco pellets substrate may be contained within the two-up rod and/or intermediate segment so that further processing may be completed while avoiding migration and/or loss of the tobacco pellets substrate. Smoking articles of the type disclosed herein may be assembled as otherwise disclosed, for example, in U.S. Pat. No. 5,469,871 to Barnes et al. or U.S. Pat. App. Pub. No. 2012/0042885 to Stone et al. or 2010/0186757 to Crooks et al., each being incorporated herein by reference.

In light of possible interrelationships between aspects of the present disclosure in providing the noted benefits and advantages associated therewith, the present disclosure thus particularly and explicitly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

EXPERIMENTAL

The present invention is more fully illustrated by the following examples, which are set forth to illustrate the present invention and are not to be construed as limiting thereof. In each example, lightability of each fuel element is determined by placing the fuel element in a smoking article of the general format set forth in FIG. 1 and placing the smoking article in a holder. Thereafter, a fuel element is exposed to a flame for a set time (e.g., 0.5 seconds, 1.0 seconds, etc.) and a puff is then taken on the smoking article of approximately 55 ml volume. The fuel element is then removed from the flame and 15 seconds is allowed to pass. Thereafter, a second puff of same volume is taken. If the fuel element glows orange/red during second puff, it is considered lit. The same general experiment is repeated, each experiment using a incrementally higher set time of flame exposure until the fuel element is considered lit at the time of the second puff. The lowest set time at which the fuel element remains lit at the time of the second puff is recorded as the lightability time. So, for example, if a particular fuel element is exposed to a flame for 0.5 seconds according to the above test and does not glow orange or red during the second puff, but does glow orange or red when retested at a flame exposure time of 1.0 seconds, then the lightability time is considered to be 1.0 seconds.

Example 1

Use of Ceramic Materials or Glass Bubbles as Ignition Aid

Several fuel element compositions comprising milled carbon, guar gum as a binder, calcium carbonate, and graphite are formed and heat-not-burn cigarettes are constructed therewith. The time required to ignite each fuel element composition is measured and compared to the commercially available ECLIPSE product (which has five exterior grooves in the fuel element) as well as another control fuel element having 8 external grooves in the fuel element. The tested compositions include varying amounts of ceramic microspheres (W-610 microspheres available from 3M) including microsphere inclusion levels of 0.05 weight percent, 0.075 weight percent, and 0.1 weight percent (wherein the milled carbon amount is reduced to accommodate the ceramic microspheres). Some of the experimental compositions are fashioned into a fuel element with either 5 or 8 external grooves, and in one case, with both 8 grooves and a center hole therethrough.

The ECLIPSE product with five grooves (no ceramic microspheres) has a lightability time of 6.0-6.5 seconds. The 8-groove control (no ceramic microspheres) has a lightability of 5.0-5.5 seconds. The 8-groove control with a center hole (no ceramic microspheres) has a lightability of 3.5 seconds.

The lightability time for the experimental fuel element with 0.05 weight percent of ceramic microspheres and 5 grooves is 3.5-4.0 seconds. The lightability time for the experimental fuel element with 8 grooves and 0.05 weight percent, 0.075 weight percent, or 0.1 weight percent of ceramic microspheres is 3.0-3.5 seconds, 3.5 seconds, 2.8-3.0 seconds, respectively. A fuel element with 8 grooves, a center hole, and 0.1 weight percent ceramic microspheres has a lightability time of 1.5 seconds.

A similar test was conducted with glass bubbles (also available from 3M) at an inclusion level of 0.05 weight percent. A fuel element containing the glass bubbles and having 8 grooves and a center hole has a lightability time of 1.8-2.0 seconds.

A similar test was conducted using fuel element compositions containing alumina powder available from CeramTec (product number T64-325) at an inclusion level of 0.1 weight percent and with 8 external grooves on the fuel element. The lightability time is within range of 3.0-3.5 seconds.

A similar test was conducted using fuel element compositions containing sand available from ACROS Organics (Fisher Scientific) at an inclusion level of 0.1 weight percent and with 8 external grooves on the fuel element. The lightability time is within range of 3.2-3.4 seconds.

A similar test was conducted using fuel element compositions containing C-glass (fiberglass) particles (formed by cutting insulation mat of ECLIPSE product into pieces) at an inclusion level of 0.1 weight percent and with 8 external grooves on the fuel element. The lightability time is within range of 3.2-4.0 seconds.

As can be seen, the presence of any of the various ceramic materials significantly reduced the lightability time as compared to the control fuel elements.

Example 2

Use of Impregnated Carbon Particles or Cellulose Particles as Ignition Aid

In a manner similar to Example 1, several fuel element compositions comprising milled carbon, guar gum as a binder, calcium carbonate, and graphite are formed and heat-not-burn cigarettes are constructed therewith. The time required to ignite each fuel element composition is measured and compared to the commercially available ECLIPSE product. The tested compositions include: (A) milled carbon, guar gum, calcium carbonate, graphite; (B) milled carbon, guar gum, calcium carbonate, graphite, and 5% by weight impregnated carbon (ST1-X impregnated carbon available from Calgon Corporation) wherein the milled carbon content was reduced 5% as compared to (A); (C) composition of (B) except with 10% by weight of impregnated carbon, wherein the milled carbon content was reduced 10% as compared to (A); (D) composition of (C) except with 15% by weight of impregnated carbon, wherein the milled carbon content was reduced 15% as compared to (A); (E) milled carbon, guar gum, calcium carbonate, graphite, and 5% by weight cellulose particles (Sigmacell cellulose available from Sigma-Aldrich) wherein all other ingredients were substantially proportionally decreased as compared to (A); (F) milled carbon, guar gum, calcium carbonate, graphite, 10% by weight ST1-X activated carbon and 5% by weight Sigmacell cellulose, wherein all other ingredients were reduced but with the milled carbon being reduced the most as compared to (A); and (G) composition of (B) except with 3% by weight of impregnated carbon, wherein the graphite content was reduced 3% as compared to (A).

The results of the lightability test are set forth in Table 1. As shown, the presence of the impregnated carbon and/or the cellulose particles decrease the time required to ignite the fuel element.

TABLE 1

| Sample | Lightability Time (seconds) |
|---|---|
| ECLIPSE | 6.0-6.5 |
| A | 5.2 |
| B | 4.1 |
| C | 3.7 |
| D | 3.8 |
| E | 4.4 |
| F | 3.5 |
| G | 4.1 |

Example 3

Use of Inorganic Salts as Ignition Aid

Several fuel element compositions comprising milled carbon, guar gum as a binder, calcium carbonate, and graphite are formed and heat-not-burn cigarettes are constructed therewith. The time required to ignite each fuel element composition is measured and compared to the commercially available ECLIPSE product (which has five exterior grooves in the fuel element) as well as another control fuel element having 8 external grooves in the fuel element.

A test similar to Example 1 is conducted using fuel element compositions containing either sodium chloride particles or potassium chloride particles at an inclusion level of 0.1 weight percent and with 8 external grooves on the fuel element. The lightability time for the fuel element containing sodium chloride is 2.8-3.0 seconds and the lightability time for the fuel element containing potassium chloride is 2.9 seconds. Accordingly, the lightability time for the experimental compositions containing inorganic salts is much lower than the control fuel elements noted in Example 1.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A fuel element adapted for use in a smoking article, comprising:

(a) a combustible carbonaceous material in an amount of at least 25% by dry weight, based on the weight of the fuel element; and (b) a non-catalytic particulate ignition aid in an amount of about 0.1% and about 20% by dry weight dispersed throughout the fuel element and selected from the group consisting of ceramic particles, cellulose particles, fullerenes, impregnated activated carbon particles, inorganic salts, and combinations thereof, wherein the average particle size of the ignition aid is less than about 1,000 microns and with the proviso that when the ignition aid is an inorganic salt, the inorganic salt is present in an amount of no more than about 0.5 dry weight percent based on the total dry weight of the fuel element.

2. The fuel element of claim 1, wherein the ignition aid comprises ceramic particles or cellulose particles having an average particle size of less than about 500 microns, the ceramic particles being glass bubbles or cenospheres.

3. The fuel element of claim 1, wherein the ignition aid comprises glass bubbles having an average particle size of about 10 to about 300 microns.

4. The fuel element of claim 1, wherein the ignition aid comprises cellulose particles having an average particle size of about 10 to about 300 microns.

5. The fuel element of claim 1, wherein the ceramic particles are metal-coated ceramic particles.

6. The fuel element of claim 1, wherein the presence of the ignition aid reduces the time required to ignite the fuel element by at least 20% as compared to a control fuel element devoid of the ignition aid.

7. The fuel element of claim 1, further comprising a binding agent, a catalytic metal material, graphite, an inorganic filler, and combinations thereof.

8. The fuel element of claim 1, wherein the impregnating agent present in the activated carbon particles is selected from the group consisting of metals, metal oxides, inorganic salts, and mineral acids.

9. The fuel element of claim 1, comprising:

(a) at least about 30% by dry weight of the combustible carbonaceous material, based on the dry weight of the fuel element;

(b) at least about 5% by dry weight of a binding agent;

(c) at least about 5% by dry weight of graphite; and (d) at least about 25% by dry weight of an inorganic filler.

10. The fuel element of claim 9, wherein the inorganic filler is calcium carbonate.

11. The fuel element of claim 9, wherein the binding agent is a natural gum.

12. An elongate smoking article having a lighting end and an opposed mouth end, said smoking article comprising:
a mouth end portion disposed at the mouth end;
a tobacco portion disposed between the lighting end and the mouth end portion; and
an aerosol-generation system disposed between the lighting end and the tobacco portion, the aerosol-generation system including a heat generation portion disposed at the lighting end, the heat generation portion comprising a fuel element according to claim 1 configured for ignition of the lighting end.

13. The smoking article of claim 12, wherein the ignition aid comprises ceramic particles or cellulose particles having an average particle size of less than about 500 microns, the ceramic particles being glass bubbles or cenospheres.

14. The smoking article of claim 12, wherein the ignition aid comprises glass bubbles having an average particle size of about 10 to about 300 microns.

15. The smoking article of claim 12, wherein the ignition aid comprises cellulose particles having an average particle size of about 10 to about 300 microns.

16. The smoking article of claim 12, wherein the ceramic particles are metal-coated ceramic particles.

17. The smoking article of claim 12, wherein the presence of the ignition aid reduces the time required to ignite the fuel element by at least 20% as compared to a control fuel element devoid of the ignition aid.

18. The smoking article of claim 12, further comprising a binding agent, a catalytic metal material, graphite, an inorganic filler, and combinations thereof.

19. An elongate smoking article having a lighting end and an opposed mouth end, said smoking article comprising:
a mouth end portion disposed at the mouth end;
a tobacco portion disposed between the lighting end and the mouth end portion; and
an aerosol-generation system disposed between the lighting end and the tobacco portion, the aerosol-generation system including a heat generation portion disposed at the lighting end, the heat generation portion comprising a fuel element configured for ignition of the lighting end, the fuel element comprising:
(a) at least about 30% by dry weight of the combustible carbonaceous material, based on the dry weight of the fuel element;
(b) about 0.1% to about 20% by dry weight of a non-catalytic ignition aid comprising ceramic particles or cellulose particles having an average particle size of less than about 500 microns, the ceramic particles being glass bubbles or cenospheres;
(c) at least about 5% by dry weight of a binding agent;
(d) at least about 5% by dry weight of graphite; and
(e) at least about 25% by dry weight of an inorganic filler.

20. An elongate smoking article having a lighting end and an opposed mouth end, said smoking article comprising:
a mouth end portion disposed at the mouth end; and
an aerosol-generation system disposed between the lighting end and the mouth end portion, the aerosol-generation system including a heat generation portion disposed at the lighting end, the heat generation portion comprising a fuel element configured for ignition of the lighting end, the fuel element comprising a combustible carbonaceous material in an amount of at least 25% by dry weight, based on the weight of the fuel element and a non-catalytic ignition aid in an amount of about 0.1% and about 20% by dry weight; and the aerosol-generation system including an aerosol-generating portion comprising a plurality of aerosol-generating elements in the form of beads or pellets comprising at least one aerosol forming material, wherein the aerosol-generating elements in the form of beads or pellets are smoke-treated with wood smoke selected from the group consisting of hickory, maple, oak, apply, cherry, mesquite, and combinations thereof.

21. The smoking article of claim 20, wherein the aerosol-generating elements further comprise one or more of particulate tobacco, a tobacco extract, and nicotine, wherein the nicotine in free base form, salt form, as a complex, or as a solvate.

22. The smoking article of claim 20, wherein the aerosol-generating elements further comprise one or more fillers, binders, flavorants, and combinations thereof.

23. The smoking article of claim 20, wherein the aerosol forming material selected from the group consisting of glycerin, propylene glycol, water, saline, nicotine, and combinations thereof.

* * * * *